US005750256A

United States Patent [19]

Ito et al.

[11] Patent Number: 5,750,256

[45] Date of Patent: May 12, 1998

[54] WATER-REPELLENT FIBER AND NONWOVENS MADE OF THE FIBER

[75] Inventors: Hidemi Ito; Masahiko Taniguchi; Yoshimi Tsujiyama, all of Moriyama; Masahito Katsuya, Yasu-gun, all of Japan

[73] Assignee: Chisso Corporation, Osaka, Japan

[21] Appl. No.: 629,507

[22] Filed: Apr. 9, 1996

[30] Foreign Application Priority Data

Apr. 17, 1995 [JP] Japan ..... 7-116484

[51] Int. Cl.[6] ..... D06M 13/256; D06M 13/402; D04H 1/42

[52] U.S. Cl. ..... 428/375; 428/364; 442/79

[58] Field of Search ..... 428/357, 364, 428/375; 442/79

[56] References Cited

U.S. PATENT DOCUMENTS 4,505,956 3/1985 Yamamoto et al. ..... 427/393.1

4,741,773 5/1988 Kuroda et al. ..... 106/2

FOREIGN PATENT DOCUMENTS 0 486 158 5/1992 European Pat. Off. .

3-180 580 8/1991 Japan .

WO 94/20664 9/1994 WIPO .

*Primary Examiner*—Kathleen Choi

*Attorney, Agent, or Firm*—Wenderoth, Lind & Ponack

[57] ABSTRACT

A water-repellent fiber having adhered to the fiber surface of a thermoplastic resin, which is a fiber a textile oil in the amount of 0.1–0.8% by weight of the fiber comprising ingredients of the following (A), (B) and (C) wherein the textile oil comprises:

(A) 5–15% by weight of at least one alkylsulfonate, (B) 5–45% by weight of at least one compound selected from polyol esters and aliphatic acid alkanol amides, and (C) 40–90% by weight of at least one compound selected from dibasic acid esters and polyethylene glycol esters.

8 Claims, No Drawings

WATER-REPELLENT FIBER AND NONWOVENS MADE OF THE FIBER

BACKGROUND OF THE INVENTION

1. Field of the Invention

The present invention provides nonwovens useful for surface materials of diapers and sanitary napkins, and a water-repellent fiber which is raw materials for the fabric and has excellent processing characteristics.

2. Description of the Prior Art

Nonwovens of synthetic fibers comprising thermoplastic resins such as polyolefin resins and polyester resins are broadly used for surface materials of diapers and sanitary napkins. These surface materials should have water permeability for rapidly absorbing liquid into an absorber in the center of such diapers and sanitary napkins, and have water repellency for protecting leakage of absorbing or absorbed liquid at the both sides.

Since hydrophobic polyolefin or polyester fibers have a property of being hard to wet, these fibers are applicable to both sides. However, these hydrophobic fibers very easily accumulate static electricity and sediment on a cylinder or a guide roll of a card machine, so that these fibers have inferior processing characteristics. To improve such processing characteristics, an antistatic agent is usually attached to the fibers. It causes trouble that the fibers being adhered the antistatic agent lose their native hydrophobic nature and water repellency to become hydrophilic.

For satisfying the hydrophobic nature or water repellency and processing characteristics or antistatic properties, Japanese Patent Application Laid-open No. 3-180580 disclosed a method for attaching a surface modifier comprising a mixture of a silicone emulsion polymer and cetyl potassium phosphate to the fibers. However, the method could not satisfy the water repellency.

An object of the present invention is to provide a water-repellent fiber for improving water repellency and antistatic properties to satisfy for practical use, and a nonwoven made of the fiber.

SUMMARY OF THE INVENTION

The inventors of the present invention earnestly have studied to resolve the above-mentioned problems and attained the invention as shown in the following.

(1) A water-repellent fiber of a thermoplastic resin which is a fiber having adhered thereto a textile oil comprising a surfactant composition on the fiber surface, characterized in that the textile oil comprises:

(A) 5–15% by weight of at least one alkylsulfonate, (B) 5–45% by weight of at least one compound selected from polyol esters and aliphatic acid alkanol amides, and (C) 40–90% by weight of at least one compound selected from dibasic acid esters and polyethylene glycol esters, and the amount of the textile oil is 0.1–0.8% by weight of the fiber.

(2) A water-repellent fiber as in the above 1, wherein the thermoplastic resin is a polyolefin resin.

(3) A water-repellent fiber as in the above 1 or 2, wherein the alkylsulfonate is a salt of alkyl sulfonic acid having an alkyl group of 8–18 carbons and at least one alkali metal selected from the group consisting of sodium, potassium and lithium.

(4) A water-repellent fiber as in the above 1 or 2, wherein the polyol ester is an ester of at least one polyol selected from the group consisting of glycerin, trimethylolethane, trimethylolpropane, pentaerythritol, sorbitol, sorbitan and sucrose, and having HLB-=-(hydrophileolipophile balance) of 5 or less.

(5) A water-repellent fiber as in the above 1 or 2, wherein the aliphatic acid alkanol amide is at least one alkanol amide of saturated or unsaturated aliphatic acids having acyl groups of 8–22 carbons.

(6) A water-repellent fiber as in the above 1 or 2, wherein the dibasic acid ester is an ester of at least one dibasic acid selected from the group consisting of adipic acid, sebacic acid, phthalic acid, terephthalic acid, succinic acid and maleic acid.

(7) A water-repellent fiber as in the above 1 or 2, wherein the polyethylene glycol ester is at least one mono or diester of aliphatic acids having alkyl groups of 8–18 and polyethylene glycols having a molecular weight of 200–800.

(8) A nonwoven made of the fiber described in any one of the above 1 to 7.

DETAILED DESCRIPTION OF THE INVENTION

The present invention is particularly described in the following.

As fibers of the material of the water-repellent fiber of the present invention, fibers comprising polyolefin resins such as polyethylene, polypropylene and ethylene-vinyl acetate copolymer, polyester resins such as polyethylene terephthalate and polyethylene terephthalate-isophthalate copolymers, or polyacrylonitrile resins, or conjugate fibers of combination of two or more thermoplastic resins are usable. In these fibers, polyolefin fibers having excellent hydrophobicity can be preferably used, because the fibers have merits capable of satisfying the water repellency and antistatic properties of the objects of the present invention.

Component (A) used in the textile oil of the present invention comprises alkyl sulfonates. As the alkyl sulfonate, a salt of alkyl sulfonic acid having an alkyl group of 8–18 carbons and alkali metal selected from the group consisting of sodium, potassium and lithium can be used. For example, sodium lauryl sulfonate, sodium myristyl sulfonate, sodium cetyl sulfonate and sodium stearyl sulfonate can be exemplified.

The alkyl sulfonate may be used as a compound or a mixture.

Component (B) used in the textile oil of the present invention may be at least one compound selected from the group consisting of polyol esters and aliphatic acid alkanol amides. Each of polyol esters and aliphatic acid alkanol amides may be a compound or a mixture. Further, it may be a mixture of polyol esters and aliphatic acid alkanol amides.

As the polyol esters, esters of at least one polyol selected from the group consisting of glycerin, trimethylolethane, trimethylolpropane, penta-erythritol, sorbitol, sorbitan and sucrose and having HLB 5 or less can be preferably used. Most preferably, glycerin monolaurate, glycerin monostearate, glycerin tristearate, sorbitan monooleate and sorbitan monostearate can be exemplified.

As the aliphatic acid alkanol amides, amides of alkanolamines and saturated or unsaturated aliphatic acids having acyl groups of 8–22 carbons may be used. As the alkanolamines, monoethanolamine, diethanolamine and N-(2-aminoethyl)-ethanolamine can be exemplified. Diethanolamine can be most preferably used. As the aliphatic acids, saturated or unsaturated aliphatic acids having 12–18 carbons such as lauric acid, myristic acid, palmitic acid, stearic acid and oleic acid can be most preferably used.

Component (C) used in the textile oil of the present invention comprises dibasic acid esters or polyethylene glycol esters. Each of dibasic acid esters and polyethylene glycol esters may be a compound or a mixture. It may be further a mixture of dibasic acid esters and polyethylene glycol esters.

As the dibasic acid esters, esters of at least one dibasic acid selected from the group consisting of adipic acid, sebacic acid, phthalic acid, terephthalic acid, succinic acid and maleic acid can be preferably used. Dioctyl adipate, dibutoxyethyl sebacate and dioctyl phthalate can be most preferably used.

As the polyethylene glycol esters, mono or diesters of polyethylene glycols having molecular weight 200–800 of polyethylene oxides and aliphatic acids having alkyl groups of 8–18 carbons may be used. For example, polyethylene glycol (400) monostearate, polyethylene glycol (300) distearate, polyethylene glycol (400) distearate and polyethylene glycol (400) monooleate can be exemplified. Most preferred esters have molecular weight 200–800 of polyethylene glycols and aliphatic acids having alkyl groups of 8–18 carbons.

The textile oil used in the present invention is a mixture of the above-mentioned components (A),(B) and (C) having a weight ratio of A/B/C=5–15/5–45/40–90 (100% by weight in total) for the total weight of the composition.

When the weight ratio of each component of the textile oil is beyond the limits of the above formulation ratio, the water repellency and antistatic properties become ill balanced and it becomes difficult to have merits of the present invention.

To the fiber of the present invention, if necessary, several kinds of stabilizers, coloring agents and other resins can be incorporated at the fiber spinning process and the other treatments can be loaded or added in the appropriate quantities.

In the present invention, the textile oil comprising the above-mentioned components is adhered to the fiber in the amount of 0.1–0.8% by weight, preferably 0.2–0.6% by weight based on the fiber weight. When the coating weight is less than 0.1% by weight, the antistatic properties are not improved. When the coating weight is beyond 0.8% by weight, the processing characteristics at the card process are lowered by undesirable lowering of crimping properties.

As a method for coating the fiber with the textile oil, a well-known method such as a method using touch rolls at a fiber-spinning process, a method using touch rolls at a fiber-stretching process or a method spraying and adhering the textile oil on the fiber after a crimp process can be used.

The nonwovens of the present invention can be obtained, by making the above-mentioned water-repellent fibers into a web having a desired basis weight and by processing the web by a well-known method such as a needle punch method, a suction drying method or a heated roll method. When the nonwovens are used as surface materials of diapers and sanitary napkins, the single yarn fineness of the water-repellent fiber of 1.0–6.0 deniers is preferable, and the basis weight of the nonwoven of 8–50 g/m$^2$ is preferable, and more preferably 10–30 g/m$^2$.

When the single yarn fineness is less than 1.0 denier, it is difficult to obtain a homogeneous web by using a card machine. When the single yarn fineness is beyond 6.0 deniers, coarse nonwovens having undesired water repellency are obtained. The surface material obtained by using such nonwovens are further undesirably rough to the touch. When the basis weight is less than 8 g/m$^2$, the surface material is too thin to obtain excellent water repellency. When the basis weight is beyond 50 g/m$^2$, although preferable water repellency is obtained, the surface is rough to the touch and the cost becomes expensive for practical use.

In the above-mentioned nonwovens, if necessary, other fibers can be mixed with the water-repellent fibers of the present invention in the appropriate quantities. As the other fibers, polyester fibers, polyamide fibers, polypropylene fibers, polyethylene fibers, rayon, cotton, wool can be exemplified. 30% or more by weight of the water-repellent fiber of the present invention is mixed with the other fiber in the nonwoven. When the amount of the water-repellent fiber is less than 30% by weight in the nonwoven, it becomes difficult to obtain necessary water repellency and antistatic properties.

DESCRIPTION OF THE PREFERRED EMBODIMENTS

The present invention is further illustrated but not limited by the following examples.

The physical values in the examples are determined by the following methods.

Amount of adhesion of textile oil: Using a Soxhlet extractor, a short fiber sample 10 g was extracted under reflux with a solvent mixed at methanol/petroleum ether=1/1 for 3 hours, and the solvent was removed to determine the weight of the textile oil.

Water repellency: A test piece of 15 cm length and width was cut from a nonwoven sample, and the water-resistant pressure (mm) was determined at a up and down rate 10 cm/min according to the method A of JIS L1092 (a low water pressure method). It shows that, when the water-resistant pressure increases, the water repellency becomes better. Nonwovens having a water-resistant pressure of 50 mm or more can be practically used.

Antistatic properties: A short fiber sample was passed over a card machine under conditions of a relative humidity of 65% at a temperature of 20° C. to obtain a web, and the electrostatic voltage generated in the web was measured. When the voltage is 100V or less, the fiber can be practically used.

EXAMPLES 1–7

COMPARATIVE EXAMPLES 1–5

The polypropylene raw material was spun into threads, and the threads were coated with each textile oil having the composition described in Table 1 by using a touch roll at a take-off process immediately after the spinning. After the take-off process, the threads were stretched to 1.5 times of the original length with a heat roll at a temperature of 40° C. The stretched threads were then crimped in a stuffer-box, dried and cut off to obtain various short fiber samples having 2d×38 mm.

The resulting short fiber samples were carded at a speed of 20 m/min with a roller carding machine to obtain webs having a basis weight of 20 g/m$^2$. The webs were heated with an embossing roll having 24% of a ratio of the adhesion area at a temperature of 130° C. and nonwovens are obtained.

The electrostatic voltage of the web measured at the carding process and the water-repellency (water resistance) of the nonwoven of each sample are shown in Table 2 (examples 1–7) and Table 3 (comparative example 1–5).

EXAMPLE 8

Conjugate fibers of a sheath/core type having conjugate ratio 50/50 that the core component was polypropylene and the sheath component was polyethylene were spun into threads. After spinning, the threads were stretched to 4.2 times of the original length with a heat roll at a temperature of 110° C. In the stretching process, the threads were coated with textile oil No. 4 described in Table 1 with a touch roll. The stretched threads were then crimped in a stuffer-box, dried and cut-off to obtain short fiber samples having 2d×51 mm.

The resulting short fiber samples were carded at a speed of 20 m/min with a roller carding machine to obtain webs having a basis weight of 20 g/m$^2$. The webs were passed over a suction dryer of 140° C. at a speed of 10 m/min to obtain nonwovens. The results of measured characteristics are shown in Table 2 with the same method as shown in Example 1.

TABLE 1

| Components of textile oil | No. | | | | | | | | | | |
|---|---|---|---|---|---|---|---|---|---|---|---|
| (% by weight) | 1 | 2 | 3 | 4 | 5 | 6 | 7 | 8 | 9 | 10 | 11 |
| A. Stearyl sulfonate Na | 10 | 10 | 5 | 10 | 5 | 10 | 10 | 2 | 25 | 10 | 10 |
| B. Glycerol tristearate | | | | 35 | | 15 | 35 | 33 | 30 | | 40 |
| Solbitan monolaurate | 9 | 10 | | | 10 | 15 | | | | 2 | |
| Lauryl diethanolamide | | 10 | 21 | | | 10 | | 10 | 5 | | 15 |
| C. Dioctylphthalate | 43 | 38 | | | 45 | | | 20 | 18 | 45 | 15 |
| Dioctyladipate | | | 32 | 20 | | 20 | 20 | | | | |
| PEG (300) distearate | | | 42 | 35 | | | | 35 | 22 | 43 | 20 |
| PEG (400) distearate | 38 | 32 | | | 40 | 30 | | | | | |
| PEG (300) monostearate | | | | | | | 35 | | | | |

PEG = polyethylene glycol

TABLE 2

| | Example | | | | | | | |
|---|---|---|---|---|---|---|---|---|
| | 1 | 2 | 3 | 4 | 5 | 6 | 7 | 8 |
| Textile oil No. | 1 | 2 | 3 | 4 | 5 | 6 | 7 | 4 |
| Adhesion amount (% by weight) | 0.35 | 0.43 | 0.51 | 0.41 | 0.30 | 0.45 | 0.38 | 0.48 |
| Electrostatic voltage (V) | <50 | <75 | <50 | <50 | <75 | <50 | <50 | <50 |
| Water repellency (mm) | 77 | 62 | 65 | 70 | 60 | 62 | 72 | 65 |

TABLE 3

| | Comparative example | | | | |
|---|---|---|---|---|---|
| | 1 | 2 | 3 | 4 | 5 |
| Textile oil No. | 8 | 9 | 10 | 11 | 4 |
| Adhesion amount (% by weight) | 0.37 | 0.41 | 0.43 | 0.39 | 0.05 |

TABLE 3-continued

| | Comparative example | | | | |
|---|---|---|---|---|---|
| | 1 | 2 | 3 | 4 | 5 |
| Electrostatic voltage (V) | 400 −500 | <50 | <50 | <50 | 300 −400 |
| Water repellency (mm) | 68 | 18 | 35 | 29 | 70 |

Since the water-repellent fibers of the present invention have excellent water repellency, when the fibers are used for surface materials of the sides of diapers and sanitary napkins after processing the fibers, excellent products able to efficiently protect the side leakage of liquids are obtained. The products further have good antistatic-properties, so that the fibers having superior processing characteristics do not wind round a cylinder of card machines or a guide roll in process steps.

We claim:

1. A water-repellent fiber of a thermoplastic resin, which is a fiber having adhered to the fiber surface a textile oil comprising a surfactant composition, wherein the textile oil comprises:

(A) 5–15% by weight of at least one alkylosulfonate, (B) 5–45% by weight of at least one compound selected from the group consisting of polyol esters and aliphatic acid alkanol amides, and (C) 40–90% by weight of at least one compound selected from the group consisting of dibasic acid esters and polyethylene glycol esters, and the amount of the textile oil is 0.1–0.8% by weight of the fiber.

2. A water-repellent fiber as claimed in claim 1, wherein the thermoplastic resin is a polyolefin resin.

3. A water-repellent fiber as claimed in claim 1 or 2, wherein the alkylsulfonate is a salt of alkyl sulfonic acid having an alkyl group of 8–18 carbons and at least one alkali metal selected from the group consisting of sodium, potassium and lithium.

4. A water-repellent fiber as claimed in claim 1 or 2, wherein the polyol ester is an ester of at least one polyol selected from the group consisting of glycerin, trimethylolethane, trimethylolpropane, pentaerythritol, sorbitol, sorbitan and sucrose, and the HLB is 5 or less.

5. A water-repellent fiber as claimed in claim 1 or 2, wherein the aliphatic acid alkanol amide is at least one alkanol amide of saturated or unsaturated aliphatic acids having acyl groups of 8–22 carbons.

6. A water-repellent fiber as claimed in claim 1 or 2, the dibasic acid ester is an ester of at least one dibasic acid selected from the group consisting of adipic acid, sebacic acid, phthalic acid, terephthalic acid, succinic acid and maleic acid.

7. A water-repellent fiber as claimed in claim 1 or 2, wherein the polyethylene glycol ester is at least one mono or diester of aliphatic acids having alkyl groups of 8–18 and polyethylene glycols having a molecular weight of 200–800.

8. A nonwoven made of the fiber described in claim 1 or 2.

* * * * *